United States Patent [19]

Staton

[11] Patent Number: 4,776,361

[45] Date of Patent: Oct. 11, 1988

[54] SHAFT

[76] Inventor: George R. Staton, 3291 Solaridge, Las Cruces, N. Mex. 88001

[21] Appl. No.: 104,261

[22] Filed: Oct. 2, 1987

[51] Int. Cl.[4] ..... A45B 3/00

[52] U.S. Cl. ..... 135/65; 135/66

[58] Field of Search ..... 135/65, 66, 78

[56] References Cited

U.S. PATENT DOCUMENTS

| | | | |
|---|---|---|---|
| 2,322,897 | 6/1943 | Bogaerde | 135/66 |
| 2,597,400 | 5/1952 | Stogsdill et al. | 135/65 X |
| 3,093,402 | 6/1963 | Sisson | 135/65 X |
| 3,363,639 | 1/1968 | Kurpis | 135/65 |
| 3,991,780 | 11/1976 | Maroski | 135/66 |
| 4,363,198 | 12/1982 | Meyer | 52/155 |

*Primary Examiner*—J. Karl Bell

*Attorney, Agent, or Firm*—Richard L. Miller

[57] ABSTRACT

This stick is designed to be a walking stick, a rescue tool, and a conversation piece. Primarily, it consists of a main body with a handle at one end and a hook is provided at the other end for engaging with a ground surface and hooking onto an article. The design further includes a cup portion for preventing the hook from sinking into soft ground, and a rope is wound on the main body and is releasable at one end when needed for rescue work, etc.

5 Claims, 1 Drawing Sheet

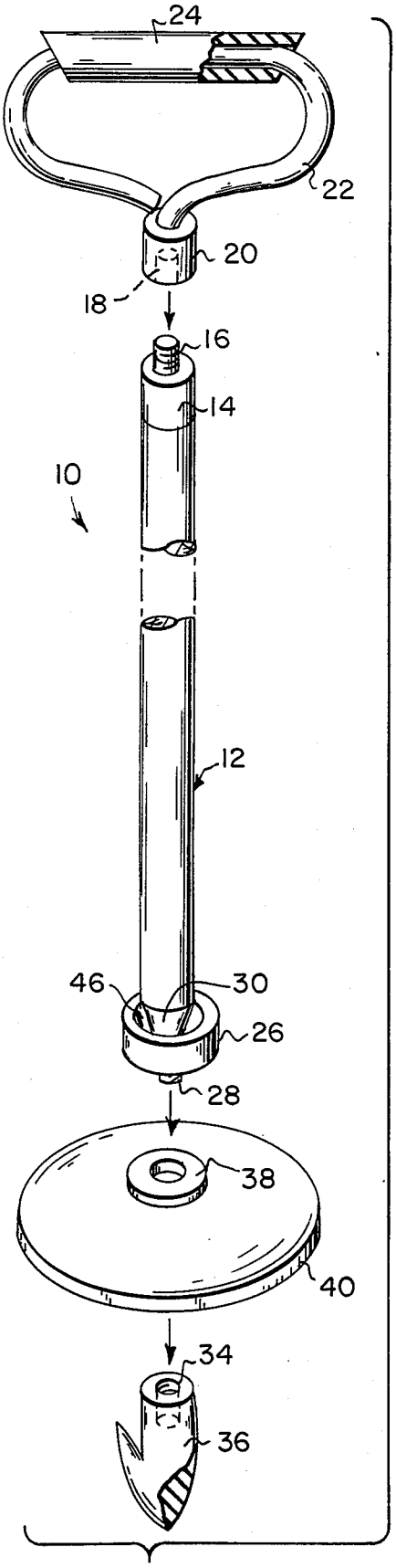
Fig. 1
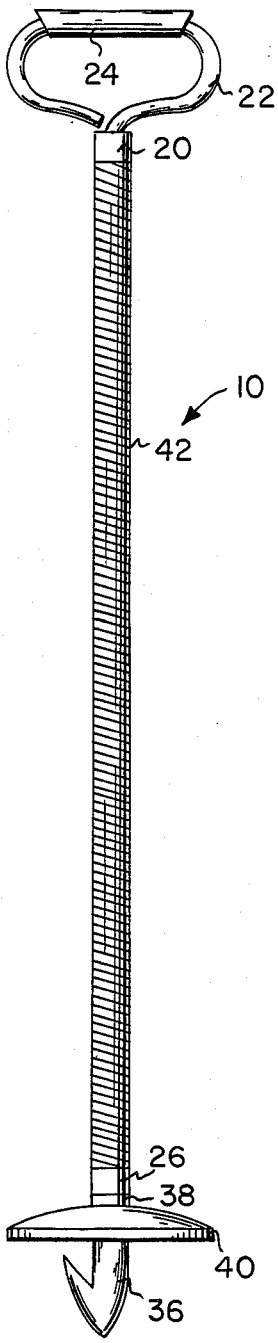
Fig. 2
Fig. 3
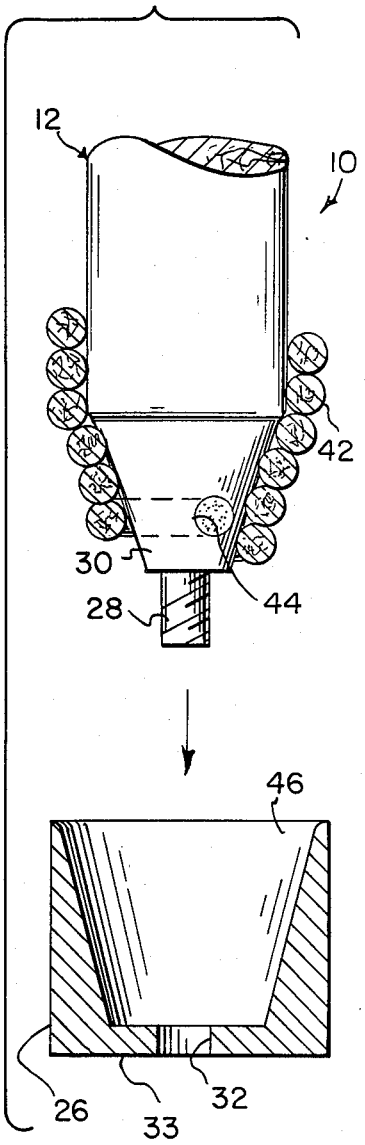

SHAFT

BACKGROUND OF THE INVENTION

The instant invention relates generally to walking sticks and the like, and more particularly, to the shaft.

Numerous walking sticks have been provided in the prior art that are adapted to be employed for various purposes. For example, U.S. Pat. Nos. 3,363,639 of Kurpis; 3,093,402 of Sisson; and 2,597,400 of Stogsdill et al all are illustrative of such prior art. While these units may be suitable for the particular purpose to which they address, they vould not be as suitable for the purpose of the present invention as hereafter described.

SUMMARY OF THE INVENTION

A primary object of the present invention is to provide a stick that will overcome the shortcomings of the prior art devices.

Another object is to provide a stick which will be unique and novel for tourists when they are in the so called down under of New Zealand and Australia.

An additional object is to provide a stick that will be useful as a walking stick and other purposes, as it will also include a rope and hook thereon.

A further object is to provide a stick that is simple and easy to use.

A still further object is to provide a stick that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a fragmentary partially perspective view of the instant invention with parts broken away;

FIG. 2 is a vertical side elevational view of the completely assembled invention per se; and FIG. 3 is an enlarged partially exploded elevational view with parts broken away showing further construction details.

DETAILED DESCRIPTION OF THE PREFERRED EMBODIMENTS

Turning now descriptively to the drawings, in which like reference characters denote like elements throughout the several views, FIGS. 1 through 3 generally illustrate a stick 10 shown to include an elongated cylindrical main body 12 fabricated of wood or other suitable material. A first metal collar 14 is provided and is fixedly secured to one end of body 12, and an externally threaded stud 16 is fixedly secured to one end of first collar 14 and is threaded into opening 18 of a second collar 20 that is received on the outside of first collar 14. A rigid rod type handle 22 is fixedly secured to second collar 20 in a suitable manner, and a foam plastic handle grip 24 is received on handle 22, providing comfort to a user's hand.

A third collar 26 is provided and a threaded stud 28 is fixedly secured to a tapered end 30 of body 12 and is freely received in an opening 32 provided through an end wall 33 of collar 26. The threaded stud 28 is threadingly received in an opening 34 provided in one end of a hard rubber hook 36. The bottom end of third collar 26 engages with the raised center portion 38 of a simulated suction cup 40 fabricated of hard rubber preferably, and the top end of hook 36 is received against the bottom surface of cup 40. A rope 42 is provided and one end is fixedly secured to body 12 below collar 14, in a manner (not shown).

The rope 42 is spirally wound on the outer periphery of body 12 and the other end is similarly wound on the tapered end 30 of body 12 and is removably received in an off-set and transverse opening 44 through through body 12. The opening 46 in the top portion of third collar 26, is similarly tapered and provides for engaging with rope 42 for firmly retaining rope 42 for any purpose.

In use, stick 10 may be generally employed as a cane and the hook 36 provides for ground engagement while the handle 22 is being gripped by a user. The cup 40 will serve as a wide area device when the user is traversing soft ground, thus preventing the hook 36 from sinking into the soft ground.

In an emergency, the hook 36 may be unscrewed, the cup 40 removed and the third collar 26 removed from the bottom end of the rope 42, enabling rope 42 to be removed from the opening 44, and unwound so as to be thrown to a person to be rescued from quick sand, water, etc.

When the above has been effected, the reverse procedure is employed to again assemble stick 10.

It shall be noted that the end of rope 42 is received in the opening 44 of the tapered end 30 of body 12, so as to prevent revealing thereof, and the third collar 26 provides further securement of rope 42, by tightly encasing this end within the confines of opening 46 thereof.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A stick, comprising, a main body, a rope secured to said main body, providing a means for said stick to be employed in rescue work, a hook received on said main body, for engagement with a ground surface and also hooking said stick onto an article when desired, a cup received on said main body providing a means of preventing said stick from sinking into soft ground, and a handle received on said main body, providing handle grip means for a user.

2. A stick as set forth in claim 1, wherein a first collar is fixedly secured to a top end of said main body and includes a projecting and externally threaded stud that is integrally attached to a closed end of said first collar, and said stud is threadingly received in an internally threaded opening provided in a second collar received over an outer periphery of said first collar, and said handle is fixedly secured to a closed end of said second collar.

3. A stick as set forth in claim 2, wherein a bottom end of said main body is tapered and one end of said rope is removably received in an off-set transverse opening provided through said bottom end of said main body, and said rope is spirally wound on said bottom end of said main body and is further spirally wound on an outer periphery of said main body.

4. A stick as set forth in claim 3, wherein another end of said rope is fixedly secured at a top of said outer periphery of said main body beneath said first collar and a second externally threaded stud is fixedly secured to said bottom end of said main body and is freely received in an opening provided in a closed end of a third collar, and a similarly tapered opening is provided in said third collar and said third collar is removably received against said rope on said bottom end of said main body, providing for further securement of said rope to said main body.

5. A stick as set forth in claim 4, wherein said third collar normally engages with a top portion of said cup when said stick is assembled, and said second stud is freely received in a central opening through said cup and is threadingly received in a threaded opening provided in one end of said hook, and said one end of said hook normally engages with a bottom surface of said cup and retains said third collar against said rope and further prevents unraveling of said rope on said main body, and removal of said hook by rotation, provides for removal of said cup for removal of one end of said rope from the opening transversely through said main body, which enables said rope to be employed in combination with said main body for rescue work.

* * * * *